United States Patent [19]

Mott et al.

[11] Patent Number: 4,510,962

[45] Date of Patent: Apr. 16, 1985

[54] PRECISE PRESSURE REGULATOR FOR A VARIABLE OUTPUT PUMP

[75] Inventors: Philip J. Mott, Des Plaines; Kenneth R. Gallaher, Lake in the Hills, both of Ill.

[73] Assignee: Borg-Warner Corporation, Chicago, Ill.

[21] Appl. No.: 509,553

[22] Filed: Jun. 30, 1983

[51] Int. Cl.[3] ..... F04B 49/08

[52] U.S. Cl. ..... 137/102; 137/637.4; 137/508; 417/220

[58] Field of Search ..... 137/102, 107, 115, 637.4, 137/508; 418/24, 25, 26, 27; 417/220; 60/452

[56] References Cited

U.S. PATENT DOCUMENTS

| | | | |
|---|---|---|---|
| 1,015,415 | 1/1912 | Banner | 137/637.4 |
| 2,716,946 | 9/1955 | Hardy | 103/37 |
| 2,740,256 | 4/1956 | O'Malley | 418/26 |
| 3,042,061 | 7/1962 | Dobrikin | 137/102 |
| 3,592,236 | 7/1971 | Meulendyk | 137/637.4 |
| 3,782,410 | 1/1974 | Steuby | 137/508 |
| 3,834,837 | 9/1974 | Nickell | 137/102 |
| 4,035,105 | 7/1977 | Dantlgraber | 417/220 |
| 4,342,545 | 8/1982 | Schuster | 418/27 |

FOREIGN PATENT DOCUMENTS

| | | | |
|---|---|---|---|
| 2600918 | 8/1977 | Fed. Rep. of Germany | 418/26 |

*Primary Examiner*—Martin P. Schwadron
*Assistant Examiner*—James R. Shay
*Attorney, Agent, or Firm*—Julian Schachner

[57] ABSTRACT

A precise pressure regulator includes a housing defining a bore having pressure and relief zones, a pressure port communicating with the pressure zone, a relief port communicating with the relief zone, and a control port. A follower is slidable and a spool is rotatable in the bore. The spool defines a first passage for communicating the pressure zone with the control port and a second passage for communicating the control port with the relief zone. A spring biases the follower in one direction tending to block the first passage. Pressure in the pressure zone biases the follower in the opposite direction tending to block the second passage. A step motor rotates the spool in discrete steps to precisely control its position, which position determines the level at which pressure is regulated.

17 Claims, 5 Drawing Figures

PRECISE PRESSURE REGULATOR FOR A VARIABLE OUTPUT PUMP

BACKGROUND OF THE INVENTION

This invention relates generally to a pressure regulator suitable for use with a variable output pump. More particularly, it relates to a pressure regulator including a control device, such as a step motor, servomotor or the like, which by controlling pump output precisely determines the pressure level at which the regulating function takes place.

A conventional pressure regulator typically includes a spring-biased valve against which is applied the force developed by a fluid pressure to be regulated. Some form of control device usually is provided for varying the spring force so that the point of equilibrium between the fluid and spring forces may be varied. By this means the pressure level at which regulation takes place is determined. In an environment where regulation is to function automatically, a motor-actuated control device typically is provided for varying the spring force. The motor generally must be heavy to insure that an adequate spring force is developed.

A step motor basically is a DC motor which rotates in specific increments or steps. Such a motor, if not overloaded, can run in the open loop mode without missing a step. One needs only keep track of the number and direction of steps taken in order to know the precise position of the rotor at all times.

A step motor could be used to precisely vary the spring force in a conventional pressure regulator. However, it would require a heavy, expensive step motor to compress the spring. As a step motor typically has low torque capacity, it would be desirable to minimize the load on the step motor in order to obtain the highest step rates with the lowest cost motor.

U.S. application Ser. No. 452,551 filed Dec. 23, 1982 is of common assignee herewith and is incorporated herein by reference. That application discloses a step motor-controlled pressure regulator having good response characteristics, stable operation and low cost. The pressure regulator represents an advance in the art, but is suited for use with a fixed output pump. Thus there remains a need in the art for a comparable pressure regulator which is suitable for use with a variable output pump.

SUMMARY OF THE INVENTION

The precise pressure regulator of this invention includes a housing defining a bore having pressure and relief zones, a pressure port communicating with the pressure zone, a relief port communicating with the relief zone, and a control port. Follower and spool members are movable in the bore. One of the members defines a first passage for communicating the pressure zone with the control port and a second passage for communicating the control port with the relief zone. A biasing force tends to move the follower member in a direction which blocks the first passage and unblocks the second passage. Pressure in the pressure zone provides a force tending to move the follower member in a direction which unblocks the first passage and blocks the second passage. The position of the spool member in the bore determines the level at which pressure is regulated.

BRIEF DESCRIPTION OF THE DRAWING

The objects and advantages of this invention will become apparent to those skilled in the art upon careful consideration of the specification herein, including the drawing, wherein.

Figures 1, 2, 3, 4, 5:
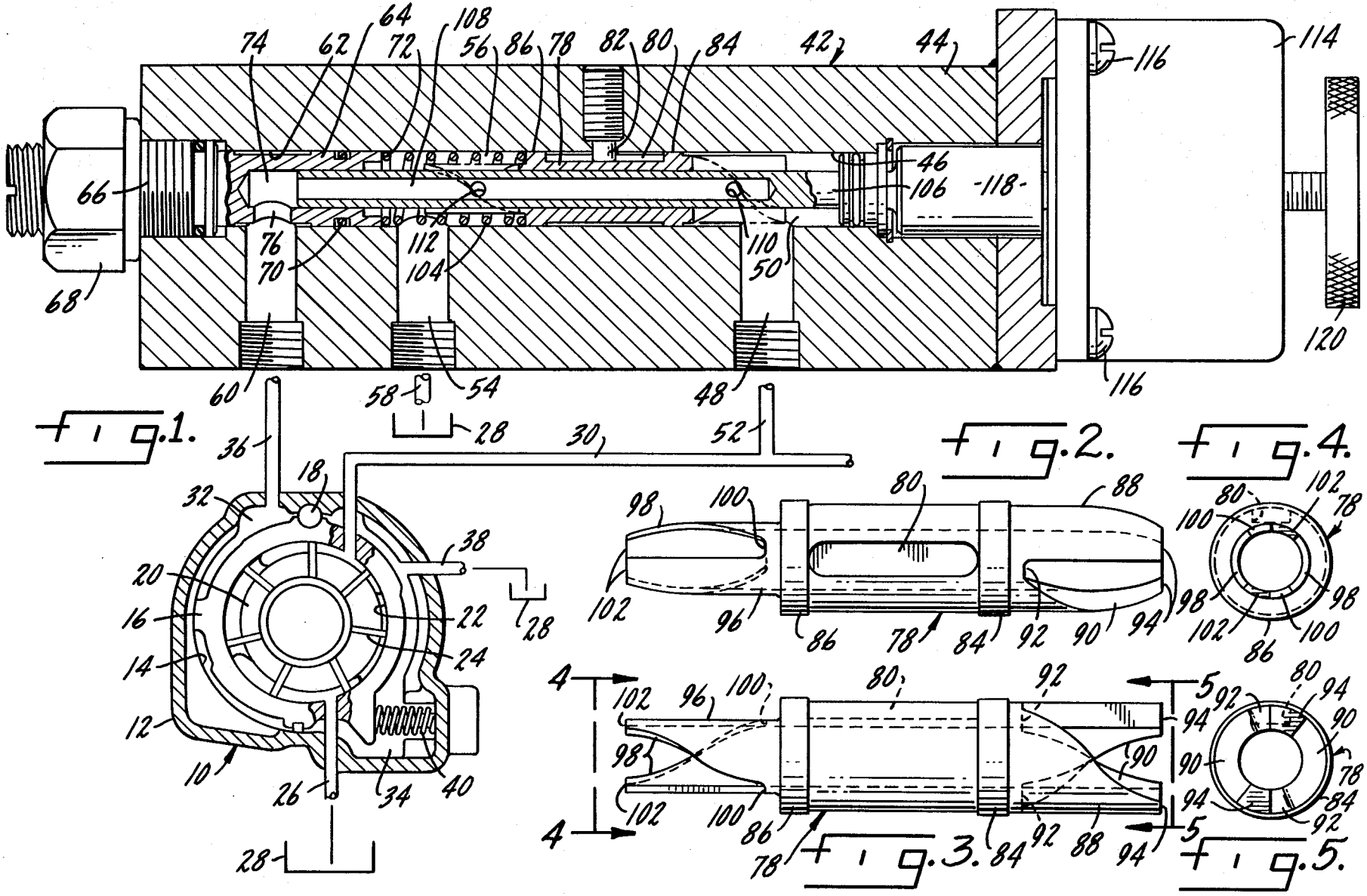
FIG. 1 is a sectional view showing details of the precise pressure regulator and associated variable output pump.
FIG. 2 is an enlarged plan view of the follower shown in FIG. 1.
FIG. 3 is an enlarged elevational view of the follower shown in FIG. 1.
FIG. 4 is an end view taken along the line 4—4 of FIG. 3.
FIG. 5 is an end view taken along the line 5—5 of FIG. 3.

While this invention is susceptible of embodiment in many different forms, the preferred embodiment is shown in the drawing and described in detail. It should be understood that the present disclosure is considered to be an exemplification of the principles of the invention, and is not intended to limit the invention to this embodiment.

DESCRIPTION OF THE PREFERRED EMBODIMENT

Turning now to the drawing in greater detail, FIG. 1 shows a variable output pump 10. For convenience, pump 10 is shown as a conventional vane type variable displacement pump. However, it should be understood that this is by way of example, and other types of variable output pumps would be suitable for use in this environment. Briefly, pump 10 includes a pump body 12 defining a cavity 14. A slide 16 is pivotable about a pivot 18 relative to a rotor 20. This pivotal movement varies the capacity of a pumping chamber 22 within which a plurality of vanes 24 create a pumping action. An inlet line 26 communicates a fluid reservoir or sump 28 with pumping chamber 22. An outlet line 30 carries line pressure and communicates pumping chamber 22 with one or more devices (not shown) to be fluid operated.

Slide 16 separates cavity 14 into a control chamber 32 and an exhaust chamber 34. A control line 36 is in communication with control chamber 32. An exhaust line 38 communicates exhaust chamber 34 with reservoir 28.

A priming spring 40 urges slide 16 toward a position which maximizes the volume of pumping chamber 22, thereby tending to maximize pump displacement. Fluid pressure in control chamber 32 opposes the force of priming spring 40, thereby tending to minimize pump displacement. By controlling the level of fluid pressure in control chamber 32, pump displacement can be controlled so as to regulate line pressure in outlet line 30.

FIG. 1 also shows the precise pressure regulator 42 of this invention. Pressure regulator 42 includes a housing 44 which defines a stepped bore 46. A first, pressure port 48 is in communication with a first, pressure zone 50 of bore 46 and, through a suitable fluid line 52, with outlet line 30. Thus, pressure zone 50 is subjected to the line pressure developed by pump 10. A second, relief port 54 is in communication with a second, relief zone 56 of bore 46 and, through a suitable fluid line 58, with reservoir 28. Relief zone 56 is thus relieved of pressure. A third, control port 60 is in communication with a third, control zone 62 of bore 46 and, through fluid line 36, with control chamber 32 of pump 10.

A retainer 64 has an outer end 66 threaded into housing 44, and is secured thereto by a suitable lock nut 68. Retainer 64 includes an O-ring 70 which effectively isolates relief zone 56 from control zone 62. At its inner end, retainer 64 defines an annular shoulder 72. Retainer 64 also defines a longitudinal passage 74 and a radial passage 76 communicating passage 74 with control zone 62 and control port 60.

A follower member 78 is slidably received in bore 46. Follower 78 defines a longitudinal slot 80. A pin 82 extends from housing 44 into slot 80 such that follower 78 is longitudinally slidable in bore 46, but cannot rotate. Follower 78 also defines lands 84 and 86 by means of which pressure zone 50 is effectively isolated from relief zone 56.

As best seen in FIGS. 2 and 3, one side 88 of follower 78 defines one or more ramp surfaces 90 extending from an inner end 92 to an outer end 94. The opposite side 96 of follower 78 is of reduced diameter and defines one or more ramp surfaces 98 extending from an inner end 100 to an outer end 102. In the preferred form of the invention, a plurality of sets of spaced ramps 90 and 98 are provided so as to balance the forces acting on follower 78.

A calibrated biasing spring 104 reacts against shoulder 72 of retainer 64 and acts upon land 86 of follower 78. This biases follower 78 rightwardly, as shown in FIG. 1, with a force that is predetermined by the position of retainer 64 and the spring rate of spring 104.

A spool member 106 is rotatably received in bore 46 in telescoping relationship with follower 78 and retainer 64. Spools 106 defines a longitudinal passage 108 opening into fluid communication with passage 74 of retainer 64. Spool 106 also defines first and second radial holes 110 and 112 communicating with passage 108 and adapted for communication respectively with pressure zone 50 and relief zone 56. In the preferred form of the invention, a plurality of spaced holes 110 and 112 are provided so as to balance the forces acting on spool 106.

Precision control means 114 may be, for example, a step motor suitably secured to housing 44 by bolts 116 or the like. Step motor 114 is mated to an extension 118 of spool 106. A manual override control element 120 may be provided for step motor 114.

The force of fluid pressure in control chamber 32 acting in opposition to the force developed by priming spring 40 determines the displacement of pump 10, and thus the line pressure in outlet line 30. This is also the pressure in pressure zone 50. The force developed by this pressure acts upon follower 78 in opposition to the biasing force of spring 104. Equilibrium is established when follower 78 assumes a position in which flow from pressure zone 50 through hole 110 is effectively blocked, and flow from passage 108 through hole 112 also is effectively blocked. In the preferred form of the invention, a negligible amount of fluid bleeds through holes 110 and 112 at equilibrium in order that hunting may be reduced as follower 78 seeks an equilibrium position. If desired, however, holes 110 and 112 could be blocked entirely by follower 78 at equilibrium.

Initial compression of spring 104 establishes the predetermined minimum threshold pressure level above which pressure regulator 42 can function. This minimum threshold pressure level may be varied by adjusting threaded end 66 of retainer 64. Regulation takes place at some higher pressure level determined by the angular position of spool 106, which in turn is precisely controlled by step motor 114.

When it is desired to change the level at which pressure in line 30 is regulated, step motor 114 is driven by some suitable device, such as a microprocessor (not shown), manual control element 120 or the like, to rotate in increments of angular displacement a predetermined number of steps. Assuming that the level of regulated pressure is to be increased, step motor 114 rotates spool 106 counterclockwise, as viewed from the right in FIG. 1, a predetermined angular distance. When this occurs, hole 110 is at least partially blocked by follower 78, and hole 112 is at least partially unblocked. Communication is thus established between control chamber 32 and relief zone 56. The pressure level in control chamber 32 decreases as fluid flows out through hole 112 to reservoir 28. Priming spring 40 pivots slide 16 about pivot 18 so as to increase the displacement of pump 10. Line pressure in line 30 increases, and this increased pressure is sensed in pressure zone 50. The force developed by this pressure acts upon follower 78 in opposition to the force of biasing spring 104. Follower 78 slides longitudinally to the left, as shown in FIG. 1, until a new equilibrium position is reached in which both holes 110 and 112 again are effectively blocked.

Assuming that the level of regulated pressure is to be decreased, step motor 114 rotates spool 106 clockwise, as viewed from the right in FIG. 1, a predetermined angular distance. When this occurs hole 110 is at least partially unblocked, and hole 112 is at least partially blocked. Communication is thus established between pressure zone 50 and control chamber 32. The pressure level in chamber 32 increases as fluid flows in through hole 110 to control chamber 32, decreasing the displacement of pump 10. Line pressure in line 30 decreases, and this decreased pressure is sensed in pressure zone 50. Follower 78 slides longitudinally to the right, as shown in FIG. 1, until a new equilibrium position is reached.

An important advantage of this arrangement is that the step motor is used only to determine the angular position of the spool, and not to apply a force directly on the biasing spring. In other words, the step motor is unloaded except for the force required to position the spool. The step motor may be a very small, simple, low cost device. Power consumption is low, as no power is required to maintain a given pressure level once the spool has been properly positioned. The step motor is an open loop control device; no feedback is required.

The increments of pressure change per digital pulse applied to the step motor may be linear or non-linear, as determined by the slopes of the ramps and/or the shapes of the holes.

The response time of the pressure regulator is very rapid, as the follower is subjected directly to line pressure at all times.

It will be apparent to those skilled in the art that there is disclosed herein a simple, inexpensive, stable precise pressure regulator for a variable output pump. The pressure is regulated by controlling pump output.

It should be understood that while the preferred embodiment of this invention has been shown and described, it is to be considered illustrative and may be modified by those skilled in the art. It is intended that the claims herein cover all such modifications as may fall within the spirit and scope of the invention.

What is claimed is:

1. A precise pressure regulator suitable for use with a variable output pump, said precise pressure regulator comprising a housing defining a bore having pressure and relief zones, a pressure port communicating with said pressure zone and adapted for communication with a pump pressure to be regulated, a relief port communicating with said relief zone and adapted for communication with a reservoir, a control port adapted for communication with a pump control pressure, follower and spool members movable in said bore, one of said members defining passage means including a first hole for communicating said pressure zone with said control port and a second hole for communicating said control port with said relief zone, and biasing means providing a force tending to move said follower member in a direction which blocks said first hole and unblocks said second hole, pressure in said pressure zone providing a force tending to move said follower member in a direction which unblocks said first hole and blocks said second hole, said members being constructed and arranged such that the position of said spool member in said bore determines the level at which pressure is regulated.

2. The precise pressure regulator of claim 1, said one member being said spool member.

3. The precise pressure regulator of claim 2, said follower member defining first and second ramp surfaces, said members being oriented such that movement of said spool member moves said first and second holes relative to said first and second ramp surfaces respectively to vary the size of the flow paths through said holes, and said members also being oriented such that movememt of said follower member moves said first and second ramp surfaces relative to said first and second holes respectively to vary the size of the fluid flow paths through said holes.

4. The precise pressure regulator of claim 3, further comprising control means for effecting controlled movement of said spool member so as to precisely determine its position in said bore.

5. The precise pressure reglator of claim 4, said follower member being slidable in said bore.

6. The precise pressure regulator of claim 5, said spool member being rotatable in said bore.

7. The precise pressure regulator of claim 6, said spool member being telescopically received by said follower member.

8. The precise pressure regulator of claim 7, further comprising a retainer in said bore, said biasing means including a spring in said bore reacting against said retainer and acting upon said follower member.

9. The precise pressure regulator of claim 8, said spool member being telescopically received by said retainer, said passage means communicating with said control port through said retainer.

10. The precise pressure regulator of claim 4, said control means being a step motor.

11. The precise pressure regulator of claim 5, said control means being a step motor.

12. The precise pressure regulator of claim 6, said control means being a step motor rotatably engaged with said spool member.

13. The precise pressure regulator of claim 7, said control means being a step motor rotatably engaged with said spool member.

14. The precise pressure regulator of claim 8, said control means being a step motor rotatably engaged with said spool member.

15. The precise pressure regulator of claim 9, said control means being a step motor rotatably engaged with said spool member.

16. A precise pressure regulator, comprising:

a housing defining a bore having pressure and relief zones, a pressure port communicating with the pressure zone, a relief port communicating with the relief zone, and a control port;

a spool, rotatable in the bore, defining a first passage for communicating the pressure zone with the control port and a second passage for communicating the control port with the relief zone;

a follower slidable in the bore; and a bias spring positioned in the bore to urge the follower in one direction, tending to block the first passage, as fluid pressure in the pressure zone urges the follower in the opposite direction, tending to block the second passage, so that a new pressure level is established by rotation of the spool, which rotation is independent of the force applied by the bias spring.

17. A precise pressure regulator as claimed in claim 16, and further comprising means, coupled to the spool, for effecting controlled, incremental angular displacement of the spool.

* * * * *

UNITED STATES PATENT AND TRADEMARK OFFICE

CERTIFICATE OF CORRECTION

PATENT NO. : 4,510,962

DATED : April 16, 1985

INVENTOR(S) : PHILIP J. MOTT and KENNETH R. GALLAHER

It is certified that error appears in the above—identified patent and that said Letters Patent is hereby corrected as shown below:

Column 3, line 32, cancel "Spools" and insert -- Spool --.

Signed and Sealed this

Sixth Day of August 1985

[SEAL]

*Attest:*

DONALD J. QUIGG

*Attesting Officer*

*Acting Commissioner of Patents and Trademarks*